US006840580B2

(12) United States Patent
Rodriguez

(10) Patent No.: US 6,840,580 B2
(45) Date of Patent: Jan. 11, 2005

(54) ADJUSTABLE LOUNGE CHAIR

(76) Inventor: Peter M. Rodriguez, 133 Santa Cruz Rd., Arcadia, CA (US) 91007

( * ) Notice: Subject to any disclaimer, the term of this patent is extended or adjusted under 35 U.S.C. 154(b) by 0 days.

(21) Appl. No.: 10/802,573

(22) Filed: Mar. 16, 2004

(65) Prior Publication Data

US 2004/0183354 A1 Sep. 23, 2004

Related U.S. Application Data

(60) Provisional application No. 60/455,694, filed on Mar. 17, 2003.

(51) Int. Cl.[7] ..... B60N 2/02
(52) U.S. Cl. ..... 297/377
(58) Field of Search ..... 297/377, 354.13

(56) References Cited

U.S. PATENT DOCUMENTS 5,547,256 A * 8/1996 D'Antuono et al. ..... 297/377
5,556,166 A * 9/1996 Synnestvedt ..... 297/377
5,681,089 A * 10/1997 Lin ..... 297/440.1
5,931,526 A * 8/1999 Tseng ..... 297/27
6,059,365 A * 5/2000 Diamond ..... 297/354.13

* cited by examiner

*Primary Examiner*—Milton Nelson, Jr.
(74) *Attorney, Agent, or Firm*—Joseph E. Mueth

(57) ABSTRACT

A lounge chair having a seat portion, an adjustable back portion rotatable about a transverse axis through roughly a 9° angle from upright to flat, and an adjustable support associated with said back portion.

The lounge chair preferably has a manually accessible lever extending from the side of the seating area to the adjustable support conventionally associated with the back to engage and re-engage the support to change the angle of the back portion with respect to the seat position while a person is seated in the lounge chair.

9 Claims, 4 Drawing Sheets

ADJUSTABLE LOUNGE CHAIR

Applicant claims the benefit of U.S. Provisional Patent Application Ser. No. 60/455,694 filed Mar. 17, 2003.

FIELD OF INVENTION

This invention resides in the field of recreational furniture.

BACKGROUND OF THE INVENTION

Lounge chairs of the type intended for patios and around swimming pools are usually constructed to be adjustable in that the back can be raised and lowered to change the angle between the seating area and the back. Lounge chairs have a long dimension on which a person may sit (upright or partially reclined) and on which a person can lay stretched out in the prone position when the back is lowered into essentially the same plane as the seat. Lounge chairs have a short or lateral dimension with the back portion being adjustable up and down about an axis which is transverse to the longitudinal dimension. Insofar as I am aware, in existing lounge chairs, the back can be lowered only if the occupant gets up and manually manipulates the back to lower it. Since 80% of all existing lounge chairs operate the same way most people can raise the backrest by pulling the upper part of the backrest to a higher position. The only way to bring the backrest down is to get up off the chair and release the claw like catches by hand.

My invention enables the occupant, while remaining seated on the lounge chair, to lower the back by simply pulling or pushing on a lever or handle.

SUMMARY OF INVENTION

Briefly, the present invention comprises a lounge chair having a seat portion, an adjustable back portion rotatable about a transverse axis through roughly a 90° angle from upright to flat, (that is, in the same plane as the seat portion), and an adjustable supporting means associated with said back portion;

the improvement comprising means manually accessible by a person while seated on the seat portion to lower the back portion through any desired angle, the means preferably comprising a lever extending from the side of the seating area to the adjustable supporting means conventionally associated with the back to engage and re-engage the supporting means to change the angle of the back.

DESCRIPTION OF THE PREFERRED EMBODIMENT

Figure 1:
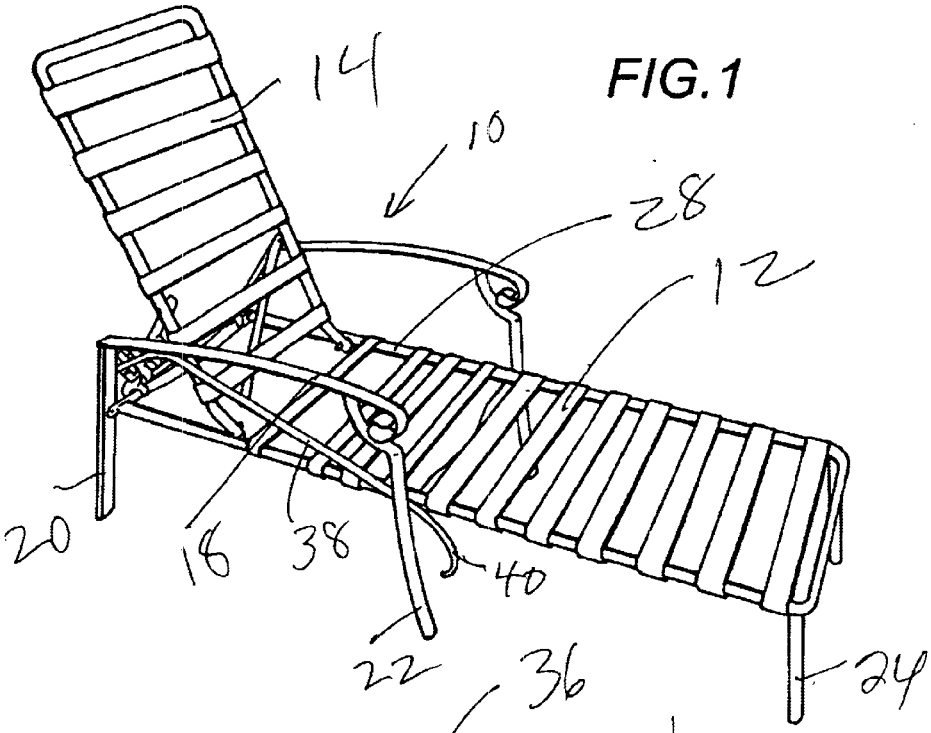
FIG. 1 is a perspective view of a typical embodiment of the invention.
Figure 2:
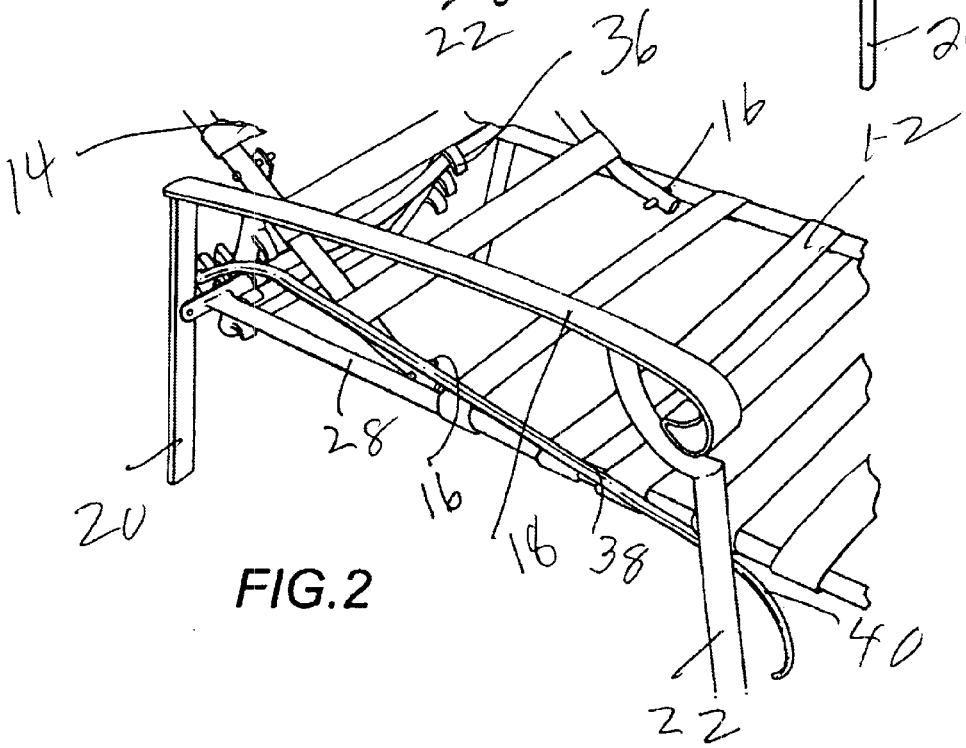
FIG. 2 is a close in view of the embodiment of FIG. 1.
Figure 3:
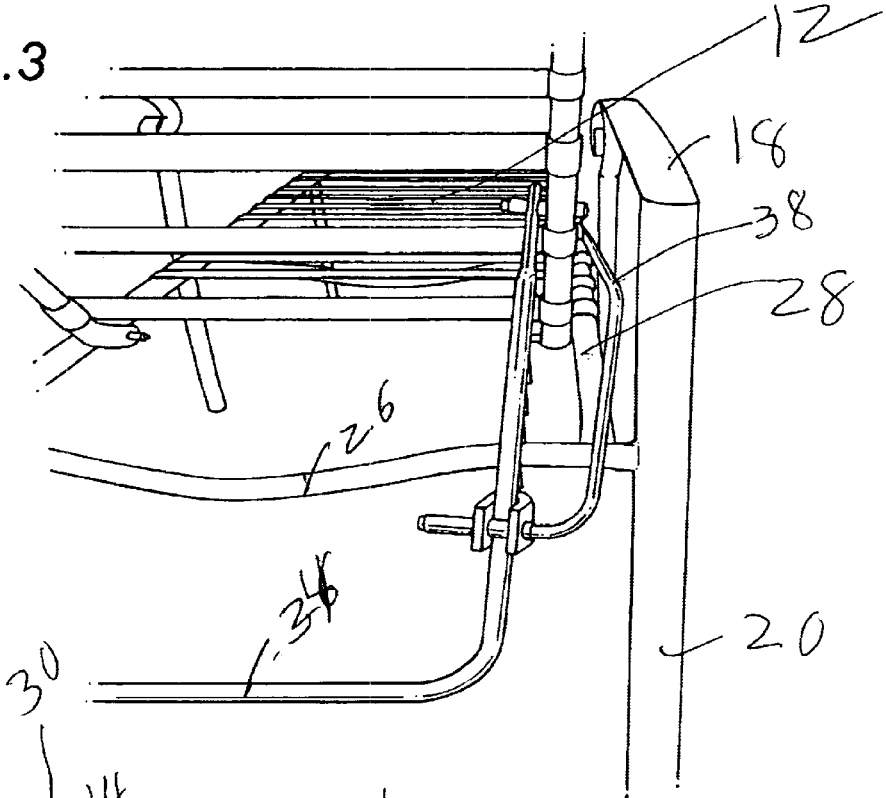
FIG. 3 is a rear view of the embodiment of FIG. 1.
Figure 4:
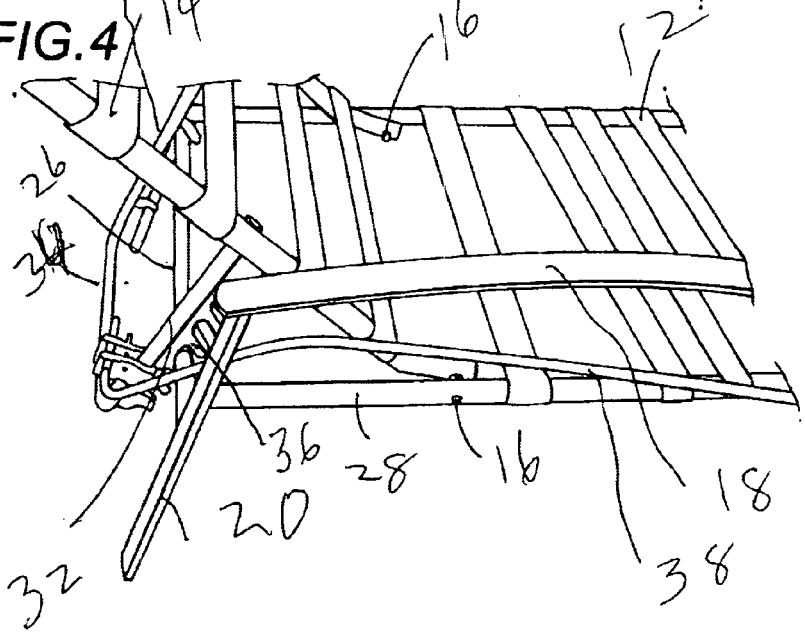
FIG. 4 is a rear side view of the embodiment of FIG. 1.
Figure 5:
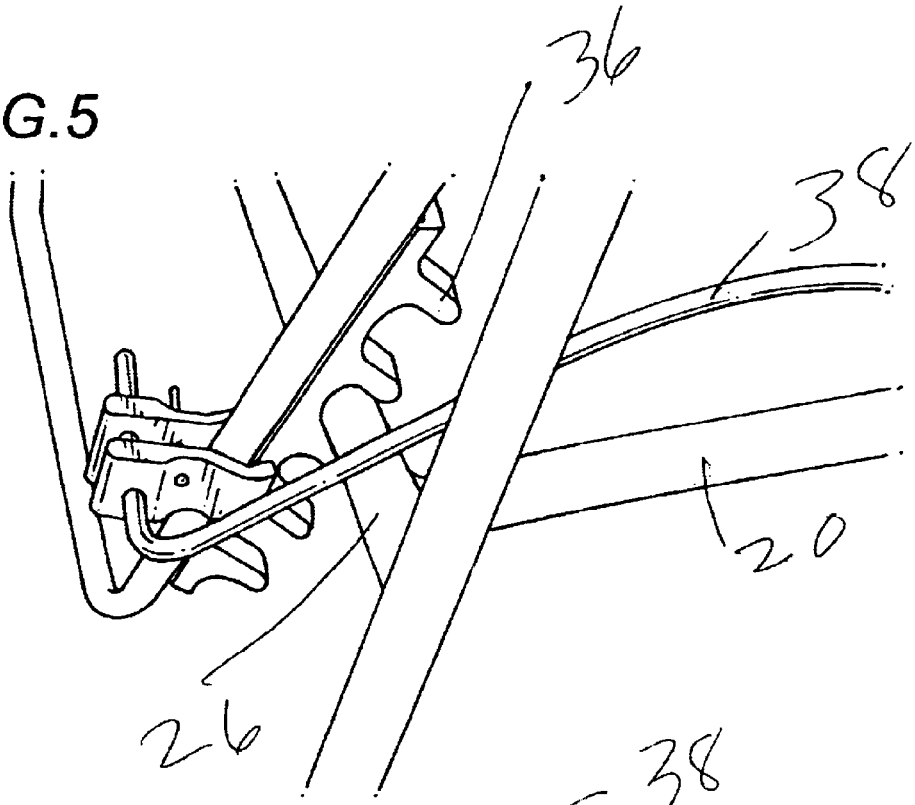
FIG. 5 is a closer side view of the connection of the lever to the back adjustment of the embodiment of FIG. 1.
Figure 6:
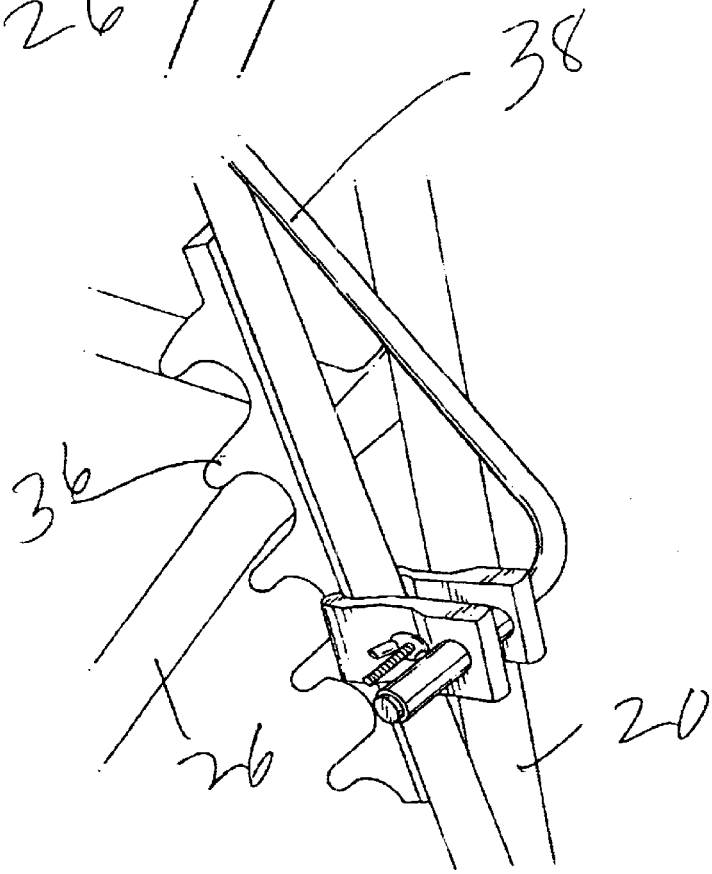
FIG. 6 is a closer side view of the connection shown in FIG. 5.
Figure 7:
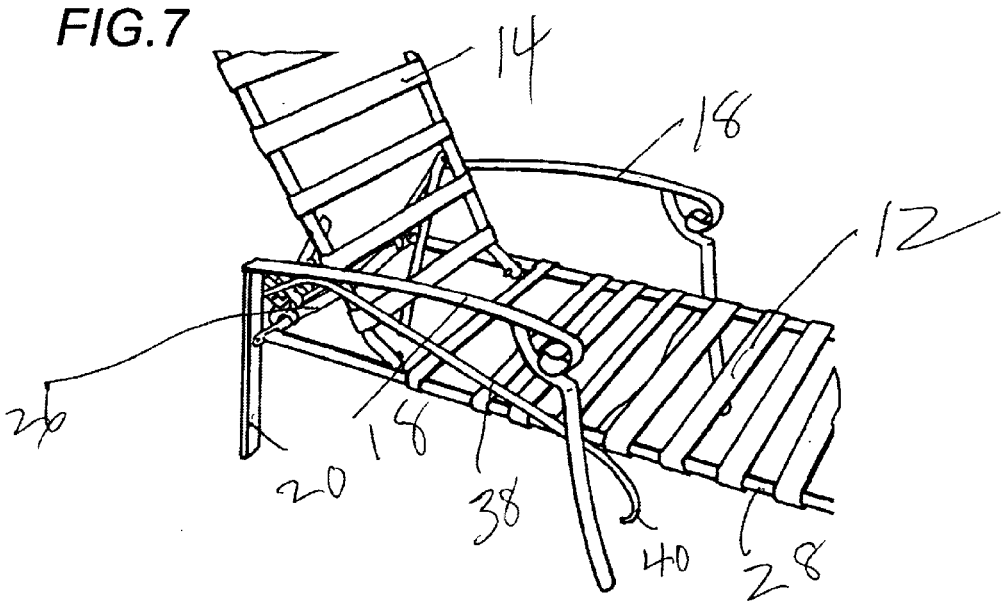
FIG. 7 is similar to FIG. 1.
Figure 8:
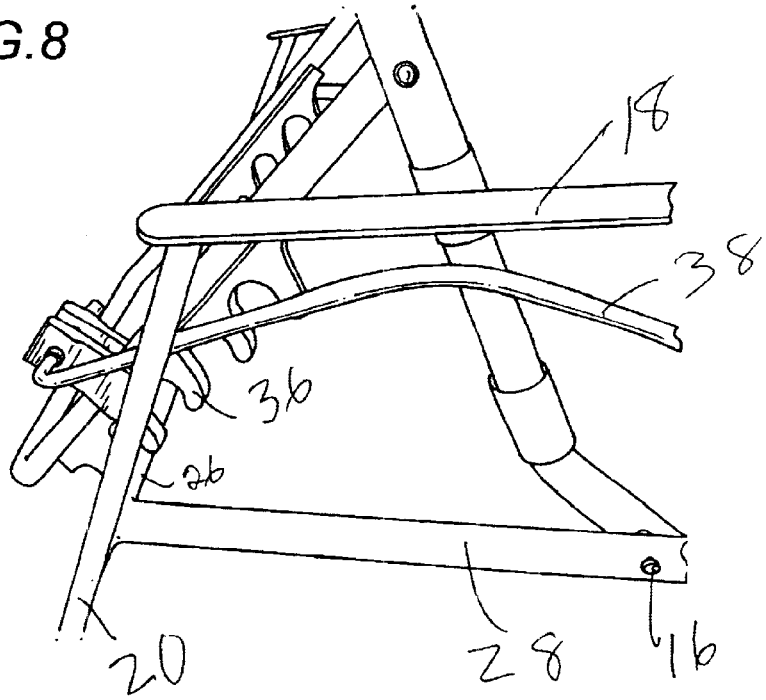
FIG. 8 is similar to FIG. 4.

In the preferred embodiment shown in the drawings, the adjustable supporting means comprises the two members, one at each side, having a plurality of claws or teeth and the fixed cross bar which engages the claws or teeth. The lever is attached to one of the claw bearing members so that while a person is seated, the lever can be grasped and pushed back, disengaging the claw bearing members to thereby allow the back portion to rotate or pivot downwardly to any extent desired. The lever is then pulled forward to re-engage the teeth on the cross bar. The claw bearing members and the rest of the frame structure of the lounge chair can be made of tubular or solid stock. The invention is not limited in regard to the composition of the frame structure.

Turning to the drawings in greater detail, the lounge chair 10 has a seating or lounging area, including space for supporting a person's legs, as shown at 12 and a back portion 14 which is rotatable in conventional manner about the pins 16. The lounge chair also has two side arms 18 and pairs of spaced apart legs 20, 22 and 24.

The fixed cross member 26 is permanently carried by the rear legs 20 and each of the side tubes or bars 28.

The back portion 14 is supported by the adjustable supporting means comprising parallel side member 30 and 32 and cross member 34. The side member 30 and 32 carry claw or teeth members 36 which area adapted to engage the fixed cross bar 26.

The improvement of this invention comprises the lever 38 which can be grasped manually at its end 40 by a seated person while in the lounging position. By grasping lever 38 at end 40 and pushing back (toward the rear of the chair), the teeth or claws members 36 become disengaged from the crossbar 26 and the back portion 14 is free to rotate downwardly to any extend desired up to 90° at which point the chair has become flat; a position sometimes favored for sun bathing. In any case, any intermediate back position can be selected. Once the desired back position has been reached, the lever 38 at end 40 is simply pulled forward to re-engage the claw or teeth members 36 on cross-member 26.

Thus, the occupant of the chair need not get up to make the desired adjustment.

While not shown, there are lounge chairs in which the claw bearing member is inside the fixed cross bar in which case the claws or teeth are on the opposite side of the claw bearing member. In this type of lounge chair, the lever is pulled forward (rather than back) to disengage the claws and lower the back and then pushed backward to re-engage the claws on the cross bar.

In the embodiment shown in the drawings, the invention includes an attachment to an existing lounge chair. This is a vise or clamp that attaches to tubing or steel bar carrying claws or teeth, located behind the backrest of a lounge chair. The clamp has a hole to allow a rod to go thru it. The rod is bent so as to run along the side of the chair to a point where a person while seated may grasp the end of the rod (or lever) with the hand.

The device of this invention allows a person to pull the upper part of the backrest just enough to release the claws or teeth and push the release bar with the rod or lever to allow the backrest to come down to the desired level.

This is a product that really allows a person to relax on a lounge chair without having to get up and step on a hot pool deck, just to lower the backrest. The product is simple to manufacture and when demonstrated would sell itself.

A simple thumbscrew connection would also encourage anyone to tackle the attachment at home.

For commercial use, (resorts, hotels, motels, public areas) a one way screw would keep someone from removing it.

Alternatively, the invention can be as a feature on a new lounge chair (at the time of fabrication)

As an original equipment item, a lounge chair can be fabricated with a hole through the bar or tube carrying the claws to achieve the same results, and by using the same bent rod as the lever.

Also by welding a 1"×1"×12 gage piece of plate with a hole to accept the bent rod (lever) would also work. The plate would be welded to one of the members carrying claws or teeth.

The attachment to an existing lounge chair can be made of: galvanized metal, different kinds of plastic, aluminum, brass, stainless steel and other suitable materials known in the art.

What is claimed is:

1. In a lounge chair having a seat portion, an adjustable back portion rotatable about a transverse axis through roughly a 90° angle from upright to flat, and an adjustable supporting means associated with said back portion;

the improvement comprising means manually accessible by a person while seated on the seat portion to lower the back portion through any desired angle from upright to flat, comprising a lever extending from the side of the seating portion to said adjustable supporting means to engage and re-engage the supporting means to change the angle of the back portion.

2. The lounge chair of claim 1 wherein the adjustable supporting means comprises two movable members, one at each side of the chair, said members having a plurality of claws or teeth members, and a fixed cross bar, said bar being adapted to engage said claws or teeth members.

3. The lounge chair of claim 2 wherein said lever is adapted to be grasped and pushed back to disengage said claws or teeth members to thereby allow the back portion to rotate or pivot downwardly to any desired extent and then pulled forward to re-engage said claws or teeth members on said cross bar.

4. The lounge chair of claim 2 wherein the lever is adapted to be grasped and pulled forward to disengage said claws or teeth members to thereby allow the back portion to rotate or pivot downwardly to any desired extent and then pushed backward to re-engage said claws or teeth members on said cross bar.

5. The lounge chair of claim 1 wherein the chair is made of tubular stock.

6. The lounge chair of claim 1 wherein the chair is made of solid stock.

7. The lounge chair of claim 1 wherein the improvement is provided as an original equipment feature.

8. The lounge chair of claim 1 wherein the improvement is provided as an after-market feature.

9. The lounge chair of claim 1 wherein said lounge chair includes parts made of galvanized metal, plastic, aluminum, brass or stainless steel.

* * * * *